United States Patent [19]

Stomp et al.

[11] Patent Number: 5,037,069

[45] Date of Patent: Aug. 6, 1991

[54] AUTOMATIC LANCE CHANGING APPARATUS

[75] Inventors: Hubert Stomp, Howald; Carlo Heintz, Meyer, both of Luxembourg; Daniel Fries, Arlon, Belgium; Serge Devillet, Bissen, Luxembourg

[73] Assignee: Paul Wurth S.A., Luxembourg

[21] Appl. No.: 474,817

[22] PCT Filed: Nov. 15, 1989

[86] PCT No.: PCT/LU89/00001

§ 371 Date: Jul. 12, 1990

§ 102(e) Date: Jul. 12, 1990

[87] PCT Pub. No.: WO90/05790

PCT Pub. Date: May 31, 1990

[30] Foreign Application Priority Data

Nov. 16, 1988 [LU] Luxembourg ..... 87387

[51] Int. Cl.[5] ..... C21C 5/46

[52] U.S. Cl. ..... 266/226

[58] Field of Search ..... 266/226

[56] References Cited

U.S. PATENT DOCUMENTS 4,893,791 1/1990 Stomp et al. ..... 266/226

FOREIGN PATENT DOCUMENTS 819185 4/1981 U.S.S.R. ..... 266/226

*Primary Examiner*—Melvyn J. Andrews

*Attorney, Agent, or Firm*—Fishman, Dionne & Cantor

[57] ABSTRACT

The invention relates to an automatic coupling for coupling lances used in steel production to a coupling head of a lance carrier, the required materials and cooling liquids being supplied to the lance through the coupling head.

Coupling takes place by means of coupling hooks (4) which are provided on the coupling head (6), mounted by means of eccentrics (12), and vertically movable by actuation of these eccentrics (12).

3 Claims, 1 Drawing Sheet

AUTOMATIC LANCE CHANGING APPARATUS

Figure 2:
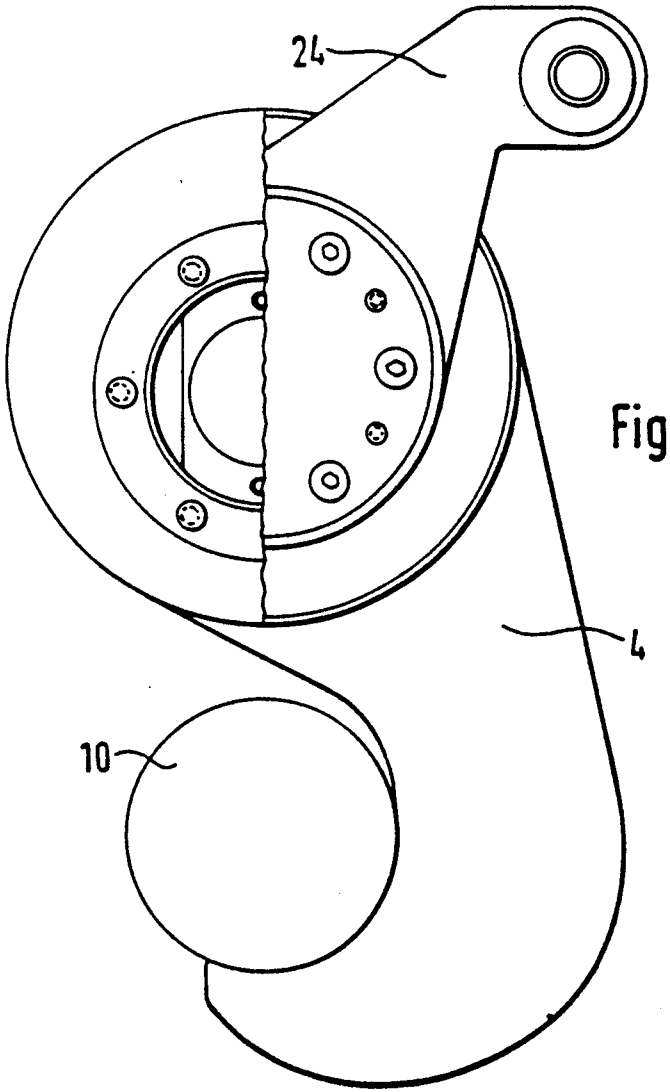

The invention relates to an automatic lance changing apparatus, in particular for lances for steel production by a top blowing process, to be coupled and fastened to a lance carrier slide which can travel vertically, the materials required for refining, and also if necessary a cooling fluid, being fed to a coupling head on the lance carrier slide and transferred at the coupling point between the coupling head and the upper part of the lance into the latter, and the coupling and attachment of the lances to the coupling head of the lance carrier slide taking place by means of two diametrically opposed coupling pins on the upper part of the lance.

A novel lance of the kind mentioned above has been disclosed in the Document LU-69797 and has the great advantage, as against the prior state of the art, that it can be connected to the associated coupling head in a single step of operation, in spite of the presence of a plurality of channels for the supply of the said materials and fluids, this step of operation consisting, in the described exemplary embodiment, of manual attachment of a respective pivot bolt connection on each side of the upper part of the lance.

For this purpose, the upper part of the lance has a flange with two diametrically opposed, laterally open attachment openings for cooperation with the two pivot bolts.

In order to automate the manual attachment of, for example, the lances with the said embodiment of the upper part of the lance, an automatic lance changing apparatus is described in Document LU-86985, and is in particular intended for lances which are provided on their upper part, not with a coupling flange but with normally two coupling pins which are preferably diametrically opposed.

Since the automation apparatus described in the said Document LU-86985 works faultlessly, it is not so much the object of the invention to remedy any possible inadequacies of the state of the art, but rather its object is to provide the user of the refining lances mentioned at the beginning, with a further possibility of choice of the optimum automation solution for his specific case of application, in particular for lances with the said coupling pins. Indeed, the apparatus according to the invention has the advantage of a less complex actuating mechanism than the apparatus described in the Document LU-86985 for lances with coupling pins.

Based on an automatic lance changing apparatus of the kind mentioned at the beginning, this object is achieved by the features set out in the main claim.

Figure 1:
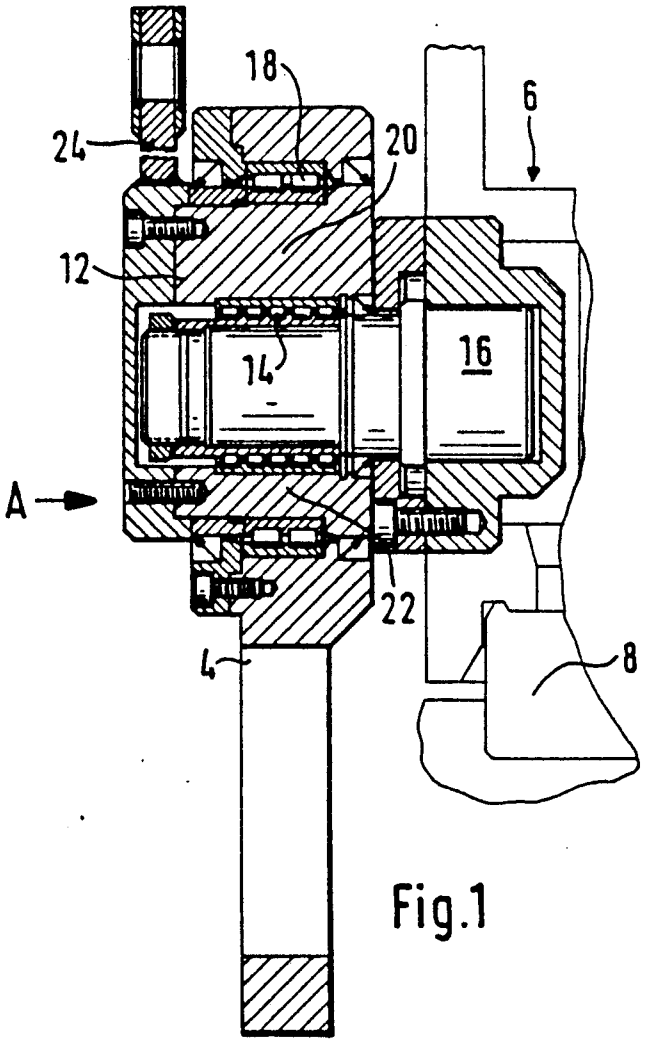

An exemplary embodiment is shown in the drawings, in which like parts are provided with like reference numerals, and is described in more detail below. In the drawings, FIG. 1 shows the front view of a section through one of the two attachment mechanisms arranged on each side of the coupling head, which is indicated in thin, continuous lines, for a lance with coupling pins;

FIG. 2 shows a side view of the subject of FIG. 1, viewed in the direction A.

It will be advantageous to consider both figures simultaneously for the following description.

A vertically displaceable attachment hook 4, which is mounted on the left, as seen in FIG. 1, on the indicated coupling head 6, is located in both figures in its highest position, in which it presses the lance, the upper part 8 of which is indicated, against the coupling head 6 by means of its coupling pin 10. Of course, an identical arrangement, not shown, is provided on the right of the coupling head 6.

The hooks 4 are in principle not designed to execute an actual pivoting motion for the release of the pin 10, but substantially only a lifting motion. If the lance 8 is to be detached in a changeover process, the two hooks 4 are lowered, so that the lance 8 is freed from the coupling head 6; it can then be taken up and removed by a transfer apparatus, not shown, such as the one indicated in FIG. 3 of the Document LU-86985. The said transfer apparatus, or a second one, now brings up a new lance 8 and suspends it with its coupling pins 10 in the hooks 4, upon which these execute a lifting motion and press the lance against the head 6 so that it is ready for operation.

A great advantage of the invention is the simplicity of the apparatus for producing the vertical motions of the hooks. An eccentric device on both sides of the coupling head is concerned here, consisting of a respective eccentric body 12 which is mounted by means of roller bearings 14 on a bolt 16 attached to the coupling head 6. The hooks 4 are mounted, likewise by means of roller bearings 18, on the circular eccentric contour of the eccentric body 12. It can be seen from FIG. 1 that the greater wall thickness 20 of the eccentric body 12 is located at the top in the illustrated state of operation, and the smaller wall thickness 22 at the bottom. This corresponds of course to the hook position for pressing the lance against the coupling head.

A respective pivot arm 24 is flanged onto each eccentric body 12 to actuate it, and in a preferred embodiment of the invention is actuated, and also held in the operating position, by a pneumatic cylinder, 26, shown schematically in FIG. 2.

We claim:

1. An apparatus for coupling a lance used for steel production in a top blowing process to a coupling head, said lance including a pair of coupling pins, comprising:

a pair of eccentric members rotatably mounted on opposite sides of the coupling head:

pivot arm means for rotating said eccentric members relative to the coupling head;

coupling hook means for engaging the coupling pins of the lance, said hook means comprising:

a pair of hooks, each of said hooks being rotatably mounted on a respective one of the pair of eccentric members and having a first position for securing the lance against the coupling head and a second position for releasing the lance from the coupling head and wherein the hooks may be moved between the first and second positions by rotation of the eccentric members.

2. The apparatus of claim 1, further comprising pneumatic means for actuating the pivot arm means.

3. The apparatus of claim 2, wherein the pneumatic means holds the pivot arms to maintain the hooks in the first position.

* * * * *